US010858767B2

(12) United States Patent
Ueda

(10) Patent No.: US 10,858,767 B2
(45) Date of Patent: Dec. 8, 2020

(54) INDUSTRIAL FABRIC

(71) Applicant: NIPPON FILCON CO., LTD., Inagi (JP)

(72) Inventor: Ikuo Ueda, Fuji (JP)

(73) Assignee: NIPPON FILCON CO., LTD., Inagi (JP)

( * ) Notice: Subject to any disclaimer, the term of this patent is extended or adjusted under 35 U.S.C. 154(b) by 0 days.

(21) Appl. No.: 16/071,713

(22) PCT Filed: Dec. 1, 2016

(86) PCT No.: PCT/JP2016/085683
§ 371 (c)(1),
(2) Date: Jul. 20, 2018

(87) PCT Pub. No.: WO2017/126234
PCT Pub. Date: Jul. 27, 2017

(65) Prior Publication Data

US 2019/0040555 A1 Feb. 7, 2019

(30) Foreign Application Priority Data

Jan. 22, 2016 (JP) ..... 2016-010801

(51) Int. Cl.
*D03D 11/00* (2006.01)
*D21F 1/00* (2006.01)
(Continued)

(52) U.S. Cl.
CPC ..... *D03D 11/00* (2013.01); *D03D 13/004* (2013.01); *D21F 1/0045* (2013.01)

(58) Field of Classification Search
CPC ..... D21F 1/0027; D21F 1/0036; D21F 7/08; D21F 1/0045; D21F 1/10; D21F 7/083;
(Continued)

(56) References Cited

U.S. PATENT DOCUMENTS 2,554,034 A * 5/1951 Koester ..... D21F 1/0027 139/426 R
3,216,893 A * 11/1965 Schuster ..... D21F 1/0027 245/8
(Continued)

FOREIGN PATENT DOCUMENTS

CA 2 654 136 A1 8/2009
JP 59-015592 A 1/1984
(Continued)

OTHER PUBLICATIONS

Translation of International patentability report of parent 371 application PCT/JP2016/085683 filed Dec. 1, 2016. (Year: 2016).*
International Search Report for PCT/JP2016/085683 (2 pgs).

*Primary Examiner* — Robert H Muromoto, Jr.
(74) *Attorney, Agent, or Firm* — Michael Best & Friedrich LLP

(57) ABSTRACT

The object of the present invention is to provide an industrial fabric which exhibits an excellent surface smoothness and an excellent filtering ability, while at the same time reduces the generation of the hydration mark.
The industrial fabric of the present invention including at least one upper surface side fabric constituted by upper surface side warps and upper surface side wefts and at least one lower surface side fabric constituted by lower surface side warps and lower surface side wefts, said at least one upper surface side fabric comprising at least one concave binding yarn for pulling down including a portion where a single knuckle is formed and at least one convex binding yarn for pushing up located to be adjacent to said at least one concave binding yarn for pulling down, and said at least one convex binding yarn for pushing up passes under at least one or more said upper surface side warps or said upper surface side wefts woven with a portion where a single knuckle of said at least one concave binding yarn for pulling down is
(Continued)

formed and includes at least two or more knuckles which are formed by passing over another upper surface side warp or another upper surface side weft located adjacent to said upper surface side warps or said upper surface side wefts.

2 Claims, 5 Drawing Sheets

(51) Int. Cl.
*D03D 13/00* (2006.01)
*D03D 3/04* (2006.01)

(58) Field of Classification Search
CPC . Y10S 162/903; Y10S 162/902; D03D 15/00; D03D 1/0094; D03D 23/00; D03D 11/00; D03D 13/04; D03D 3/08; D03D 13/00; D03D 3/04
See application file for complete search history.

(56) References Cited

U.S. PATENT DOCUMENTS 3,596,858 A * 8/1971 Curtis ..... B01D 29/093 245/10
4,149,571 A * 4/1979 Burroughs ..... D21F 1/0027 139/383 A
4,281,689 A * 8/1981 Benedyk ..... D02G 3/02 139/420 A
4,423,755 A * 1/1984 Thompson ..... D21F 1/0027 139/383 A
4,529,013 A * 7/1985 Miller ..... D03D 15/00 139/383 A
4,569,375 A 2/1986 Borel
4,676,278 A * 6/1987 Dutt ..... D21F 1/0027 139/383 AA
4,832,090 A * 5/1989 Krenkel ..... D21F 1/0036 139/383 A
4,989,647 A * 2/1991 Marchand ..... D21F 1/0036 139/383 A
4,996,100 A * 2/1991 Druckman ..... D03D 15/00 442/213
5,103,875 A * 4/1992 Tate ..... D21F 1/0045 139/383 A
5,158,118 A * 10/1992 Tate ..... D21F 1/0027 139/383 A
5,429,686 A * 7/1995 Chiu ..... D03D 23/00 139/383 A
5,487,414 A * 1/1996 Kuji ..... D21F 1/0036 139/383 A
5,518,042 A * 5/1996 Wilson ..... D21F 1/0045 139/383 A
5,632,310 A * 5/1997 Yasuoka ..... D03D 23/00 139/383 A
5,713,398 A * 2/1998 Josef ..... D21F 1/0027 139/383 A
5,832,962 A * 11/1998 Kaufman ..... D21F 1/0027 139/383 A
5,853,547 A * 12/1998 Ahrens ..... D21F 1/0027 162/348
5,944,062 A * 8/1999 Gampe ..... D03D 11/00 139/383 A
6,077,397 A * 6/2000 Shipley ..... D21F 1/0036 162/358.1
6,227,255 B1 * 5/2001 Osterberg ..... D21F 1/0027 139/383 A
6,431,221 B1 * 8/2002 Wrigley ..... D03D 3/04 139/383 AA
6,790,314 B2 * 9/2004 Burazin ..... D21F 1/0027 139/383 A
7,395,840 B2 * 7/2008 Ito ..... D03D 3/08 139/383 A
9,303,363 B2 * 4/2016 Chou ..... D21H 27/40
9,404,224 B2 * 8/2016 Chou ..... D21H 27/40
9,415,564 B2 * 8/2016 Breuer ..... C04B 28/02
9,574,306 B2 * 2/2017 Chou ..... D21H 27/40
9,611,591 B2 * 4/2017 Chou ..... D21H 27/40
9,915,032 B2 * 3/2018 Chou ..... D21H 27/40
9,957,667 B2 * 5/2018 Chou ..... D21H 27/40
9,988,766 B2 * 6/2018 Chou ..... D21H 27/40
2005/0067039 A1 * 3/2005 LaFond ..... D21F 1/0045 139/383 A
2006/0278296 A1 * 12/2006 Ito ..... D03D 3/08 139/383 A

FOREIGN PATENT DOCUMENTS

JP 2003-342889 A 12/2003
JP 2006-152498 A 6/2006
JP 2006-348403 A 12/2006
JP 2008-057052 A 3/2008
JP 2015-017340 A 1/2015

* cited by examiner

INDUSTRIAL FABRIC

TECHNICAL FIELD OF THE INVENTION

The present invention relates to an industrial fabric which exhibits an excellent surface smoothness and an excellent filtering ability, while at the same time reduces the generation of the hydration mark, in particular, relates to an industrial fabric which is capable of preventing the mark from consecutively diagonally generating on the surface of an object to be produced.

BACKGROUND ART

Fabrics obtained by weaving warps and wefts have conventionally been used widely as an industrial fabric. They are, for example, used in various fields including papermaking fabrics, conveyor belts and filter cloths and are required to have fabric properties suited for the intended use or using environments. Of such fabrics, a papermaking fabric used in a papermaking step for removing water from raw materials by making use of the network of the fabric must satisfy a severe demand.

For example, there is a demand for the development of fabrics which do not transfer a wire mark of the fabric and therefore have excellent surface property, the ones which have enough hydration property for sufficiently and uniformly hydrating excess water contained in the material and enough rigidity or wear resistance to be usable desirably even under severe environments, or the ones which are capable of maintaining conditions necessary for making good paper for a prolonged period of time.

In addition, fiber supporting property, improvement in a paper making yield, dimensional stability and running stability are demanded.

In recent years, owing to the speed-up of a paper making machine, requirements for papermaking fabrics become severe further.

Since most of the demands for industrial fabrics and solutions thereof can be understood if papermaking fabrics on which the most severe demand is imposed among industrial fabrics is described, the papermaking fabric will hereinafter be described as a representative example.

Recently, particularly excellent hydration property and surface smoothness have been required due to the high speed operation of a machine for fabric. Although the required hydration property varies in accordance with the machine and the product papers, the uniform hydration property and the fiber supportability are commonly required for all the product papers.

In addition, the fiber supportability is considered to be crucial, since old papers in which much fine fibers are contained has been increasingly used in recent years, and the fabric with an excellent hydration property has become required, since the hydration property is decreased upon the formation of the sheet with much fine fibers contained therein.

Further, in the fabric for producing papers, a hydration operation in a centrifugal or a pressing manner is generally conducted by utilizing a network of the fabric, however, water is sucked to be hydrated from an underside of the network in order to obtain a sufficient hydration property, so that the required properties such as the fiber supportability, the hydration property influences much on the operation or the cost for producing papers.

In this connection, it is publicly known that binding yarns has been used for binding the fabric forming a plurality of layers in an industrial fabric with two or more structures. Since such binding yarns is adapted to weave with the plurality of layers constituting the fabric, it is publicly known that a tension caused by the binding yarns is higher than that by yarns other than the binding yarns. In addition, in the industrial fabric, a reciprocally complementing structure in which two upper and lower surface side yarns are arranged adjacent to each other in such a way that one upper surface side yarn does not form a knuckle at a location where a knuckle is formed on the upper surface side fabric, while one lower surface side yarn forms a knuckle on the upper surface side fabric (refer to Patent Publication 1) has been adopted nowadays.

Since the upper surface side yarns are arranged inside at a location where a knuckle of such an upper surface side yarns are complemented by the lower surface side yarns, the density of the warps substantially becomes double. As the density of the warps becomes large, the hydration property deteriorates at such a large density area. In addition, if the binding ratio is enhanced by increasing the number of the binding yarns in such a structure of the fabric, portions where the hydration property deteriorates are caused to be equally aligned with each other, so that a line where the hydration property deteriorates is formed in accordance with a shape of such an alignment, and as a result, hydration marks are formed on the surface of the papers.

In order to solve above technical problem with respect to the hydration property, an industrial two-layered fabric in which a set of two yarns (an upper surface side warp and a lower surface side warp, for instance) are arranged between two binding yarns forming a set has been developed (refer to Patent Publications 2, 3).

Although, in the two-layer fabric for making papers in Patent Publications 2,3, the technical problems of the hydration marks and the surface smoothness has been largely improved, another technical problem has arisen. That is the technical problem of marking diagonally generating on the object to be produced.

After the cause for this technical problem was analyzed in detail, it was found that concave portions which are diagonally arranged in a consecutive manner were formed on the upper surface of the fabric, in the conventional industrial fabric. FIG. 7 is a photograph showing a drawing pattern which emerges when a thin paper is applied to the upper surface of the fabric and is traced by a thick pencil, etc.

As clearly shown in FIG. 7, the consecutive diagonal drawing pattern (a white line) is formed on the industrial two-layered fabric of the Patent Publications 2, 3. For instance, a diagonal line is put in FIG. 7 in order to clarify the existence of such a drawing pattern. It was found that such a diagonal drawing pattern is the cause for the marking diagonally generated on the object to be produced. Required properties in a higher level for the industrial fabric can be met if the marking diagonally generated on the object to be produced can be removed and the formation of the concave portions concave which are diagonally arranged in a consecutive manner can be controlled. The present invention was created in order to solve such a technical problem in the conventional industrial fabric.

Patent Publication 1: Japanese Patent Laid-open Publication 2003-342889

Patent Publication 2: Japanese Patent Laid-open Publication 2015-17340

Patent Publication 3: Canadian Patent Laid-open Publication No. 2654136

DISCLOSURE OF THE INVENTION

Technical Problems to be Solved by Present Invention

The object of the present invention is to provide an industrial fabric which exhibits an excellent surface smoothness and an excellent filtering ability, while at the same time reduces the generation of the hydration mark. In particular, the object of the present invention is to provide an industrial fabric which is capable of preventing the mark from consecutively diagonally generating on the surface of an object to be produced by regularly separating the concave portions generated on the upper surface of the fabric.

Means to Solve Technical Problems

The industrial fabric of the present invention includes following technical features in order to solve the above technical problems.

(1) The industrial fabric of the present invention including at least one upper surface side fabric constituted by upper surface side warps and upper surface side wefts and at least one lower surface side fabric constituted by lower surface side warps and lower surface side wefts, said at least one upper surface side fabric comprising at least one concave binding yarn for pulling down including a portion where a single knuckle is formed and at least one convex binding yarn for pushing up located to be adjacent to said at least one concave binding yarn for pulling down, and said at least one convex binding yarn for pushing up passes under at least one or more said upper surface side warps or said upper surface side wefts woven with a portion where a single knuckle of said at least one concave binding yarn for pulling down is formed and includes at least two or more knuckles which are formed by passing over another upper surface side warp or another upper surface side weft located adjacent to said upper surface side warps or said upper surface side wefts.

(2) In addition, in the industrial fabric of the present invention, said at least one concave binding yarn for pulling down is arranged to be adjacent to said one or more said upper surface side warps or said upper surface side wefts so as to form a set with said one or more said upper surface side warps or said upper surface side wefts.

(3) Still further, in the industrial fabric of the present invention, said at least one concave binding yarn for pulling down forms the single knuckle by passing over only one upper surface side warp or only one upper surface side weft.

(4) Still further, in the industrial fabric of the present invention, said at least one concave binding yarn for pulling down forms the single knuckle by passing over two adjacent upper surface side warps or two adjacent upper surface side wefts in a consecutive manner.

(5) Still further, in the industrial fabric of the present invention, said at least one concave binding yarn for pulling down and said at least one concave binding yarn for pushing up are yarns for binding warps.

Effect of the Invention

According to the industrial fabric of the present invention, the generation of the hydration mark can be reduced and the excellent surface smoothness and the excellent filtering ability can be obtained. In particular, in the industrial fabric of the present invention, the excellent effect can be caused in such a way that the marking can be prevented from diagonally and consecutively generating on the surface of the produced object which regularly divides the concave portion on the upper surface of the fabric.

DETAILED DESCRIPTION OF THE INVENTION

Figure 1:
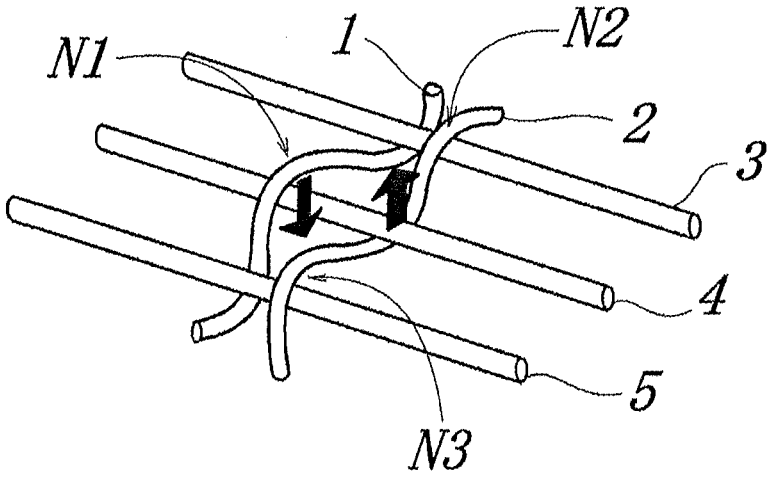
FIG. 1 is a conceptual view showing an effect of the industrial fabric according to the present invention.

Now, the structure and the effect of the fabric of the present invention will be described below. Embodiments of the fabric of the present invention will be described thereafter with reference to the drawings. In this connection, since the embodiment is just an example of the present invention, the embodiment which is not described hereinafter can be encompassed by the scope of the present invention.

The industrial fabric of this embodiment includes at least one upper surface side fabric constituted by upper surface side warps and upper surface side wefts and at least one lower surface side fabric constituted by lower surface side warps and lower surface side wefts, said at least one upper surface side fabric comprises at least one concave binding yarn for pulling down including a portion where a single knuckle is formed.

In this connection, the concave binding yarn for pulling down is defined to be a binding yarn which binds the upper surface side fabric and the lower surface side fabric and includes a portion where a single knuckle is formed by passing over one or two upper surface side warps or upper surface side wefts. Such a concave binding yarn for pulling down possesses a force for drawing the upper surface side warps or the upper surface side wefts inside the fabric at the portion where the single knuckle is formed, since it is hooked by the lower surface side fabric. In addition, since the concave binding yarn for pulling down forms the single knuckle, an effect in which such a force for drawing the upper surface side warps or the upper surface side wefts inside the fabric is focused on the portion where the single knuckle is formed is caused.

Still further, a single knuckle represents a situation in which the concave binding yarn for pulling down forms a knuckle at a single location in a complete structure of the fabric. In other words, the concave binding yarn for pulling down can be defined to be a binding yarn which includes a single knuckle in the complete structure of the fabric. In a case where the concave binding yarn for pulling down is the warp, it is woven with the upper surface side weft at only one location in the complete structure of the fabric. On the other hand, In a case where the concave binding yarn for pulling down is the weft, it is woven with the upper surface side warp at only one location in the complete structure of the fabric.

In addition, in the industrial fabric of the present invention, at least one convex binding yarn for pushing up is located to be adjacent to the at least one concave binding yarn for pulling down, and the at least one convex binding yarn for pushing up includes at least two knuckles which are formed by passing under at least one or more said upper surface side warps or said upper surface side wefts woven with said knuckle forming portion of said at least one concave binding yarn for pulling down and passing over another upper surface side warp or another upper surface side weft located adjacent to said at least one or more said upper surface side warps or said upper surface side wefts.

In this connection, the convex binding yarn for pushing up is defined to be a binding yarn which binds the upper surface side fabric and the lower surface side fabric and is located adjacent to the concave binding yarn for pulling down. In addition, the convex binding yarn for pushing up scoops the upper surface side warps of the upper surface side wefts between at least two single knuckles from below which at least two single knuckles are formed by the convex binding yarn for pushing up at the both sides in the direction in which the yarns of the portion where the single knuckle is formed extend. In this connection, the both sides in the direction in which the yarns extend is defined to be two upper surface side wefts arranged upper and lower, respectively, in the direction in which the warps of the fabric extend, in a case where the concave binding yarn for pulling down is the warp. On the other hand, the both sides in the direction in which the yarns extend is defined to be two upper surface side warps arranged right and left, respectively, in the direction in which the wefts of the fabric extend, in a case where the concave binding yarn for pulling down is the weft. In this connection, the convex binding yarn for pushing up may include knuckles in the complete structure of the fabric other than the above-described two knuckles. For instance, the industrial fabric including three or more knuckles is encompassed by the technical scope of the present invention.

By adopting such a structure, the convex binding yarn for pushing up possesses a force for pushing up the upper surface side warps or the upper surface side wefts which is drawn inside the fabric of the convex binding yarn for pushing up toward the upper surface side, at the portion where the convex binding yarn for pushing up forms the single knuckle.

FIG. 1 is a conceptual view showing the effect of the above-described concave binding yarn for pulling down and the convex binding yarn for pushing up.

In FIG. 1, a yarn 1 is the concave binding yarn for pulling down. In addition, a yarn 2 is the convex binding yarn for pushing up. Three yarns 3,4,5 are arranged in the direction perpendicular to the direction in which the binding yarns extend. The concave binding yarn for pulling down and the convex binding yarn for pushing up in this embodiment may be either the weft or the warp. Here, in this embodiment, the concave binding yarn for pulling down and the convex binding yarn for pushing up are presumed to be the warps, in view of the convenience of the explanation of the embodiment.

In the industrial fabric of this embodiment, the concave binding yarn 1 for pulling down functions to bind the upper surface side fabric and the lower surface side fabric. Accordingly, it is known that a force for drawing the upper surface side weft woven at the upper surface side is stronger than that caused by the yarns other than the binding yarns. In particular, in the present invention, the upper surface side weft 4 is adapted to be drawn inside by the stronger force by making a knuckle N1 of the concave binding yarn 1 for pulling down single. In other words, as shown in FIG. 1, in the concave binding yarn 1 for pulling down in the present invention, a force for strongly drawing the upper surface side weft 4 inside in the direction in which the fabric extends inside is generated by an arrow.

The technical feature of the present invention lies in the fact that one convex binding yarn 2 for pushing up is arranged at a location adjacent to the concave binding yarn 1 for pulling down. Such a convex binding yarn 2 for pushing up is woven with the upper surface side wefts 3, 5 arranged on the both sides of the upper surface side weft 4 woven at the portion N1 forming the single knuckle of the concave binding yarn 1 for pulling down. In other words, the convex binding yarn 2 for pushing up forms the knuckles N2, N3 at two locations. The convex binding yarn 2 for pushing up is adapted to be woven with the upper surface side weft 4 so as to scoop the upper surface side weft 4 from below, between the knuckles N2, N3. Such being the case, a stress is generated so as to push up the upper surface side weft 4 in the direction indicated by an arrow, between the two knuckles N2, N3 of the convex binding yarn 2 for pushing up.

Accordingly, an effect in which a force for drawing the upper surface side weft 4 generated at a location of the single knuckle N1 of the concave binding yarn 1 for pulling down is cancelled by a force for pushing up the upper surface side weft 4 generated between the two knuckles N2, N3 of the convex binding yarn 2 for pushing up adjacent to the concave binding yarn 1 for pulling down is caused.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

As to the diameter of the yarn constituting the fabric, it is preferable that the diameter of the upper surface side weft be smaller than that of the lower surface side weft, in view of the surface smoothness, the fiber supportability, etc., and any diameter of the warp may be appropriately selected, the diameter of all the warps may be the same, or the diameter of the lower surface side warp may be larger than that of other warps, for instance.

Figure 2:
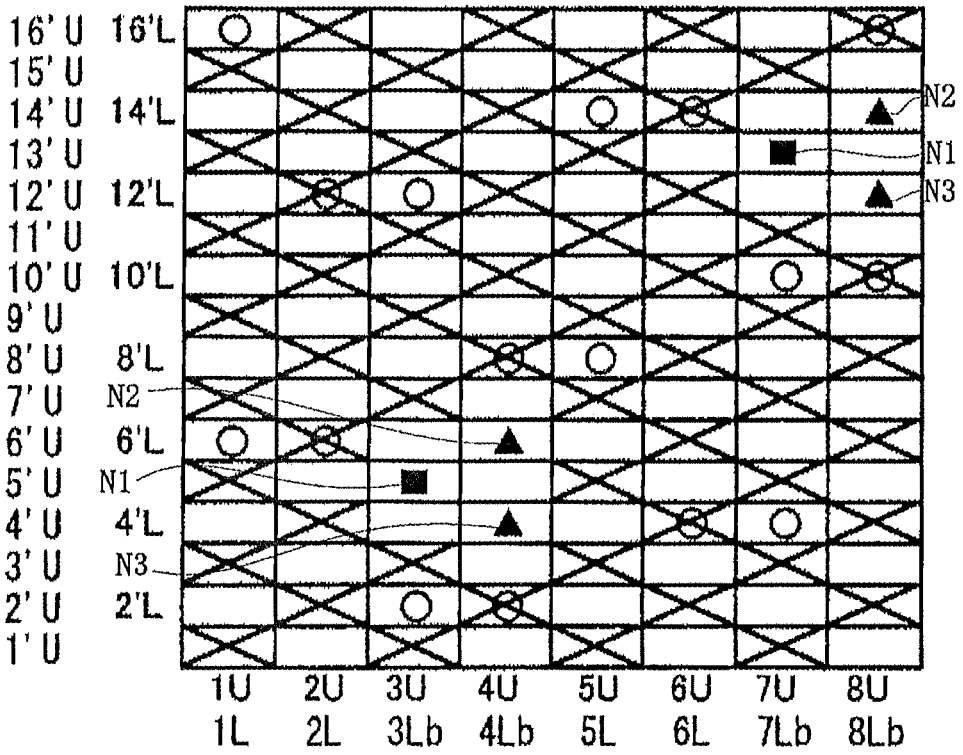
FIG. 2 is a design view of the industrial fabric according to the first embodiment of the present invention.
Figure 3:
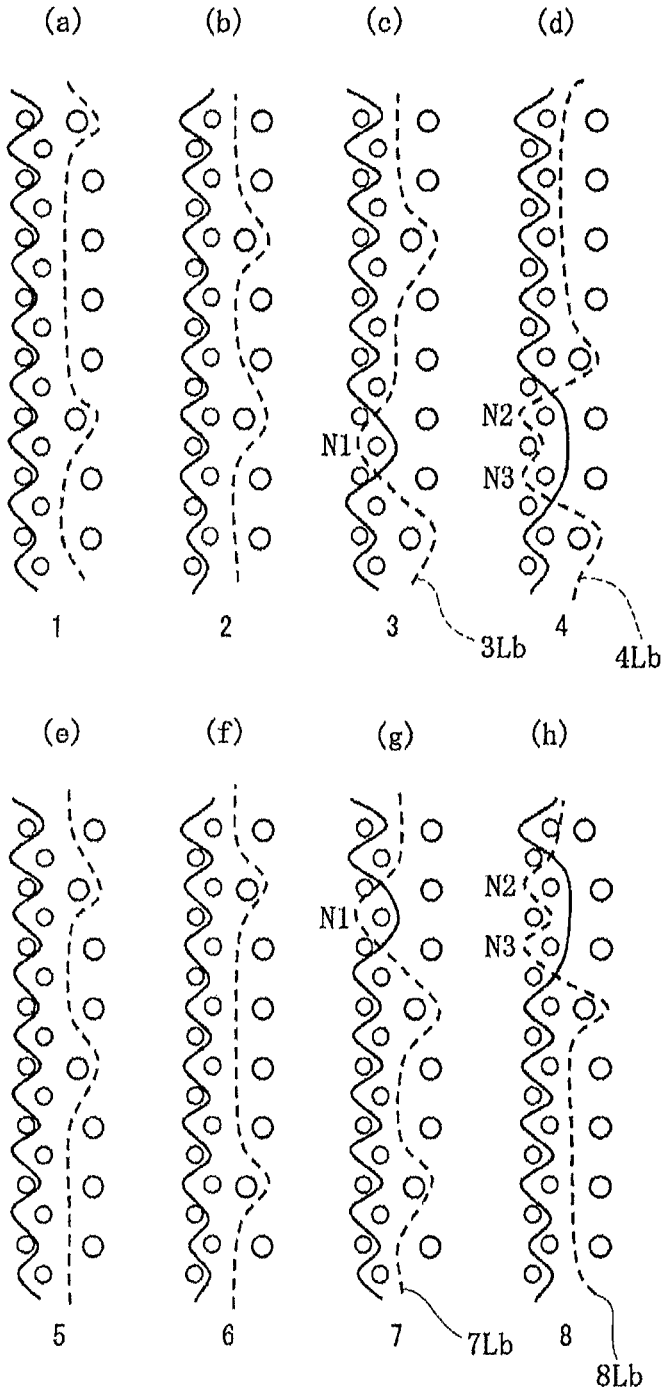
FIG. 3 is a longitudinal cross section view showing a structure of the yarns with respect to the industrial fabric according to the first embodiment of the present invention.
Figure 4:
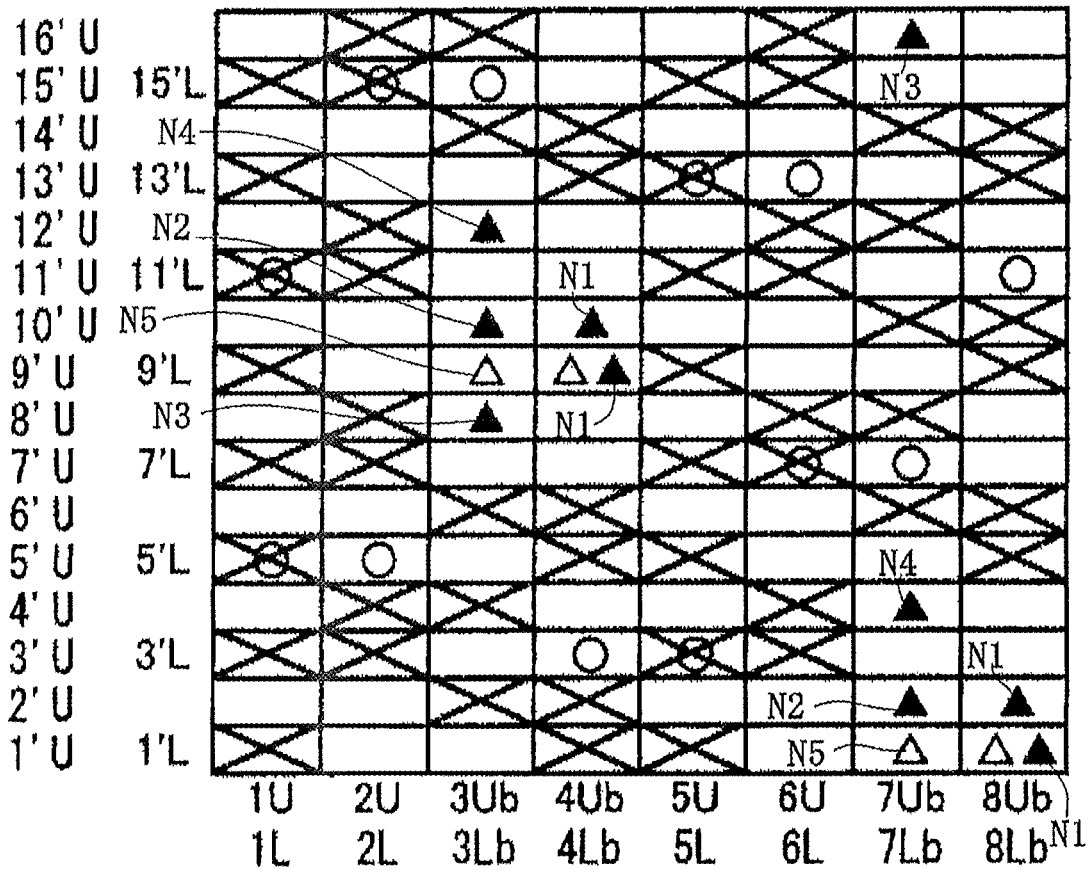
FIG. 4 is a design view of the industrial fabric according to the second embodiment of the present invention.
Figure 5:
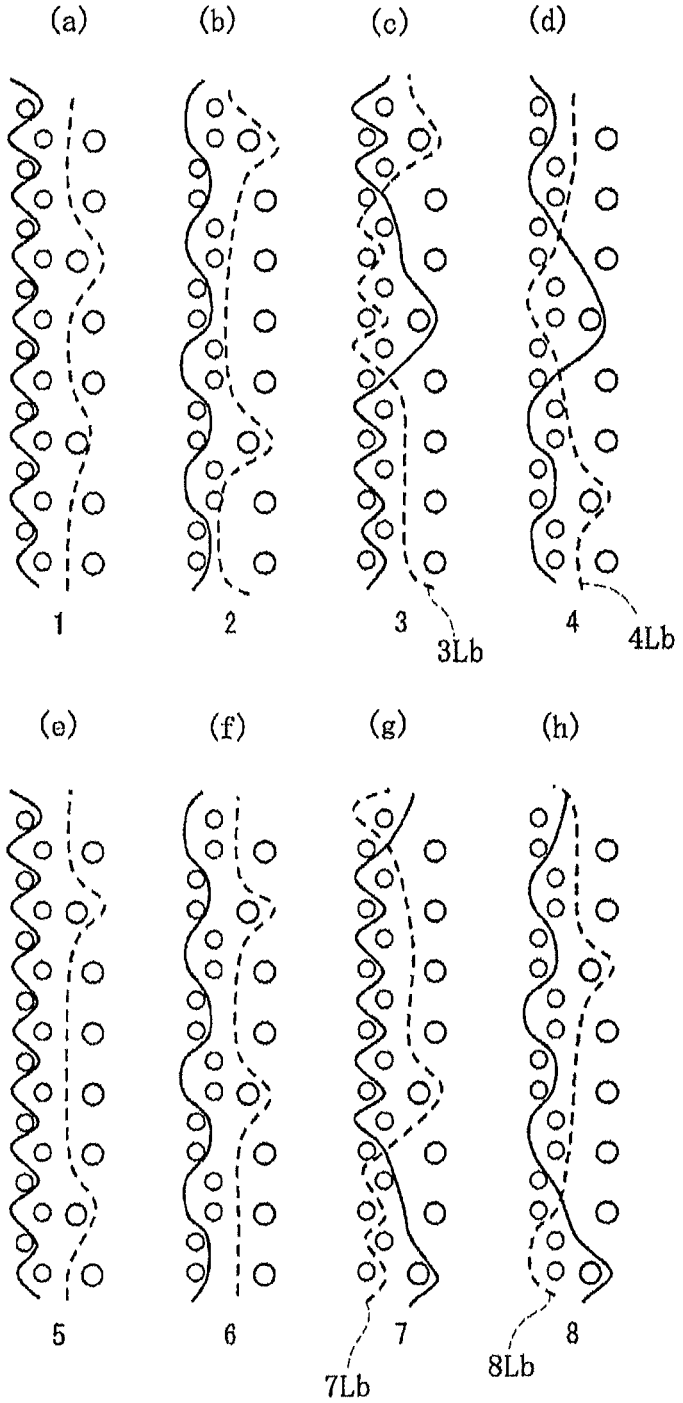
FIG. 5 is a longitudinal cross section view showing a structure of the yarns with respect to the industrial fabric according to the second embodiment of the present invention.

Now, the embodiments of the present invention will be described below with reference to the drawings. FIG. 2 is a design view of the industrial fabric according to the first embodiment of the present invention. FIG. 3 is a longitudinal cross section view showing a structure of the yarns with respect to the industrial fabric according to the first embodiment of the present invention. FIG. 4 is a design view of the industrial fabric according to the second embodiment of the present invention. FIG. 5 is a longitudinal cross section view showing a structure of the yarns with respect to the industrial fabric according to the second embodiment of the present invention.

Here, the design view corresponds to the complete structure of the fabric defining the minimum unit to be repeated of the fabric structure. A structure of the whole fabric is formed by the complete structures woven with each other in the upper and lower directions, and in the left and right directions. In addition, the longitudinal cross sectional view is the one showing a situation in which the warps are woven with each other in the complete structure. In each of the design views, the warp is indicated by a reference number such as 1,2,3 . . . . The warp binding yarn weaving the upper and lower wefts is indicated by the reference number to which b is attached. The upper and lower warps are indicated by the reference number to which U and L are attached, respectively. In each of the design views, the warps with the same reference numbers indicate to form a set, so that, in FIG. 2, the upper surface side warp U and the lower surface side warp L, the upper surface side warp U and the binding yarn b, and the upper surface side binding yarn Ub and the lower surface side binding yarn Lb form a set, respectively, for instance.

The weft is indicated by a reference number such as 1', 2', 3' . . . . There is a case in which the upper surface side wefts and the lower surface side wefts are arranged upper and lower, respectively, and there is another case in which the only upper surface side wefts are arranged upper. The upper surface side weft and the lower surface side weft are indicated by the reference number to which U and L are attached, respectively, such as 1'U, 2' L, etc.

In each of the design views, a symbol "○" indicates that the lower surface side warp is arranged under the lower surface side weft to form a knuckle, and a symbol "X" indicates that the upper surface side warp (U) is arranged above the upper surface side weft to form a knuckle, and a symbol "Δ" indicates that the warp binding yarn (b) is arranged under the lower surface side weft to form a knuckle, and a symbol "■" indicates that the yarn functioning as the concave binding yarn among the warp binding yarns (b) is arranged above the upper surface side weft to form a single knuckle, and a solid triangle symbol "▲" indicates that the yarn functioning as the convex binding yarn for pushing up among the warp binding yarns (b) is arranged above the upper surface side weft to form a knuckle.

In the design view, the warps and the wefts on the upper surface side are depicted to be precisely arranged over the warps and the wefts on the upper surface side, because of the clarity of the drawing. In the real fabric, it does not matter if they are arranged to be offset.

In particular, FIGS. 2 and 4 show that the concave portions are regularly separated from each other by using the symbols "■" and "▲".

First Embodiment

FIGS. 2 to 3 are a design view and a cross section view showing an industrial fabric according to the first embodiment, respectively.

As shown in FIG. 2, the fabric of the first embodiment includes upper surface side warps (1U—8U), lower surface side warps (1L,2L,5L,6L), and lower surface side warps 3Lb, 4Lb,7Lb, 8Lb each serving as a binding weft yarn. In addition, the fabric of the first embodiment includes upper surface side wefts (1'U—16'U), and lower surface side wefts (2'L, 4'L, 6'L,8'L,10'L, 12'L, 14'L,16'L) to form sixteen shafts.

An arranging ratio of the upper surface side wefts (1'U~16'U) to the lower surface side wefts (2'L, 4'L . . . ) is two.

In this embodiment, as shown in FIG. 3, the upper surface side warps 1U, 2U, 5U, 6U are woven with the upper surface side wefts in an alternate manner. In addition, the lower surface side warps 1L, 2L, 5L, 6L pass under the two lower surface side wefts.

Among the lower surface side wefts each serving as a binding weft yarn, the lower surface side wefts 3Lb, 7Lb are the concave binding yarns for pulling down. As shown in FIG. 3(*c*), the concave binding yarn 3Lb for pulling down passes under the lower surface side weft 2'L and passes over the upper surface side weft 5'U to pass under the lower surface side weft 12'L to bind the upper surface side fabric and the lower surface side fabric. In addition, as shown in FIG. 3(*g*), the concave binding yarn 7Lb for pulling down passes under the lower surface side weft 4'L and passes under the lower surface side weft 10'L to pass over the upper surface side weft 13'U to bind the upper surface side fabric and the lower surface side fabric. The technical feature of the lower surface side wefts 3Lb, 7Lb lies in the fact that they form a single knuckle at the upper surface side fabric. A location where the single knuckle is formed is a portion ■(N1) where the lower surface side wefts 3Lb, 7Lb pass over the upper surface side wefts 5'U,13'U. At the portion ■(N1), a force by which the binding yarn draws the upper surface side wefts woven therewith inside is stronger than that at other locations. In particular, in the industrial fabric according to the first embodiment, the upper surface side wefts 5'U,13'U are adapted to be drawn inside by the stronger force by making the portion ■(N1) where the knuckle of the concave binding yarns 3Lb, 7Lb for pulling down is formed single Among the lower surface side warps each serving as a binding weft yarn, the lower surface side warps 4Lb, 8Lb are the concave binding yarns for pulling down. As shown in FIG. 2, the lower surface side warps 4Lb, 8Lb are arranged adjacent to the above-described concave binding yarns 3Lb, 7Lb for pulling down. In addition, the above-described concave binding yarns 4Lb, 8Lb for pulling down pass under the upper surface side wefts 5'U,13'U woven at the portion N1 where the single knuckle of the above-described concave binding yarns 3Lb, 7Lb is formed and passes over the upper surface side wefts 4'U,6'U or the upper surface side wefts 12'U,14'U adjacent to the upper surface side wefts 5'U,13'U to form two knuckles ▲(N2,N3). By adopting such a structure, the above-described concave binding yarns 4Lb, 8Lb for pulling down are woven so as to scoop the upper surface side wefts 5'U,13'U from below, between the two knuckles A (N2,N3). Such being the case, a stress for pushing up the upper surface side wefts 5'U,13'U is generated between the two knuckles ▲(N2,N3) of the concave binding yarns 4Lb, 8Lb for pulling down. Accordingly, a force for drawing the upper surface side wefts 5'U,13'U generated at the location of the single knuckle N1 of the concave binding yarns 3Lb, 7Lb for pulling down is cancelled by a stress for pushing up the upper surface side weft 5'U generated on the two knuckles ▲(N2,N3) of the concave binding yarns 4Lb, 8Lb for pulling down adjacent to the concave binding yarns 3Lb, 7Lb.

Therefore, the formation of the concave portions consecutively generated can be controlled in order to prevent the marking from diagonally generating on the produced object. In addition, by adopting the industrial fabric according to the first embodiment, the marking can be prevented from diagonally generating on the surface of the produced object by regularly dividing the concave portions generated on the upper surface of the fabric.

Second Embodiment

FIGS. 4 to 5 are a design view and a cross section view showing an industrial fabric according to the second embodiment, respectively.

As shown in FIG. 4, the fabric of the second embodiment includes upper surface side warps (1U,2U,5U,6U), lower surface side warps (1L,2L,5L,6L), lower surface side warps (3Lb, 4Lb,7Lb, 8Lb) each serving as a binding weft yarn, and upper surface side warps (3Ub, 4Ub,7Ub, 8Ub) each serving as a binding weft yarn. In addition, the fabric of the second embodiment includes upper surface side wefts (1'U~16'U), and lower surface side wefts (1'L, 3'L, 5'L,7'L, 9'L, 11'L, 13'L,15'L) to form sixteen shafts.

An arranging ratio of the upper surface side wefts (1'U, 2'U . . . ) to the lower surface side wefts (2'L, 4'L . . . ) is two.

In this embodiment, as shown in FIG. 5, the upper surface side warps 1U, 5U are woven with the upper surface side wefts in an alternate manner. In addition, the upper surface side warps 2U, 6U are woven with two upper surface side wefts in an alternate manner. In addition, the lower surface side warps 1L, 2L, 5L, 6L pass under the two lower surface side wefts.

Among the lower surface side warps each serving as a binding weft yarn, the lower surface side warps 4Lb, 8Lb are the concave binding yarns for pulling down. As shown in FIG. 5(*d*), the concave binding yarn 4Lb for pulling down passes under the lower surface side weft 3'L and passes over the upper surface side wefts 9'U, 10'U to bind the upper surface side fabric and the lower surface side fabric. The technical feature of the concave binding yarn 4Lb for pulling down lies in the fact that it forms a single knuckle at the upper surface side wefts 9'U, 10'U. In addition, as shown in FIG. 5(*h*), the concave binding yarn 8Lb for pulling down passes under the lower surface side weft 11'L and passes over the upper surface side wefts 1'U, 2'U to bind the upper surface side fabric and the lower surface side fabric. The technical feature of the concave binding yarn 7Lb for pulling down lies in the fact that it forms a single knuckle at the upper surface side wefts 1'U, 2'U. A location where the single knuckle is formed is a portion ■ (N1) where the concave binding yarns 4Lb, 8Lb pass over the upper surface side wefts 1'U,2'U and the upper surface side wefts 9'U, 10'U. At the portion ■ (N1), a force by which the binding yarn draws the upper surface side wefts woven therewith inside is stronger than that at other locations. In particular, in the industrial fabric according to the second embodiment, the upper surface side wefts 1'U,2'U, 9'U,10'U are adapted to be drawn inside by the stronger force by making the portion ■ (N1) where the knuckle of the concave binding yarns 1'U,2'U for pulling down and the concave binding yarns 9'U,10'U for pulling down is formed single Among the lower surface side warps each serving as a binding weft yarn, the lower surface side warps 3Lb, 7Lb are the concave binding yarns for pushing up. As shown in FIGS. 5(*c*), 5(*d*), the concave binding yarns 3Lb, 7Lb for pushing up are arranged adjacent to the above-described concave binding yarns 4Lb, 8Lb for pulling down. In addition, the above-described concave binding yarns 3Lb, 7Lb for pushing up pass under the upper surface side wefts 9'U, 1'U woven at the portion N1 where the single knuckle of the above-described concave binding yarns 4Lb, 8Lb for pulling down is formed and passes over the upper surface side wefts 8'U,10'U or the upper surface side wefts 2'U,16'U adjacent to the upper surface side wefts 9'U, 1'U to form two knuckles ▲(I\12,N3). By adopting such a structure, the above-described concave binding yarns 3Lb, 7Lb for pushing up are woven so as to scoop the upper surface side wefts 9'U, 1'U from below, between the two knuckles ▲(N2,N3). Such being the case, a stress for pushing up the upper surface side wefts 9'U, l'U is generated between the two knuckles ▲(N2,N3) of the concave binding yarns 3Lb, 7Lb for pushing up. Accordingly, a force for drawing the upper surface side wefts 9'U, 1'U generated at the location of the single knuckle N1 of the concave binding yarns 4Lb, 8Lb for pulling down is cancelled by a stress for pushing up the upper surface side weft 9'U or the upper surface side weft 1'U generated on the two knuckles ▲(N2,N3) of the concave binding yarns 3Lb, 7Lb for pushing up adjacent to the concave binding yarns 4Lb, 8Lb for pulling down.

Therefore, the formation of the concave portions consecutively generated can be controlled in order to prevent the marking from diagonally generating on the object to be produced. In addition, by adopting the industrial fabric according to the second embodiment, the marking can be prevented from diagonally generating on the surface of the object to be by regularly separating the concave portions generated on the upper surface of the fabric from each other.

Embodiment 1

Figure 6:
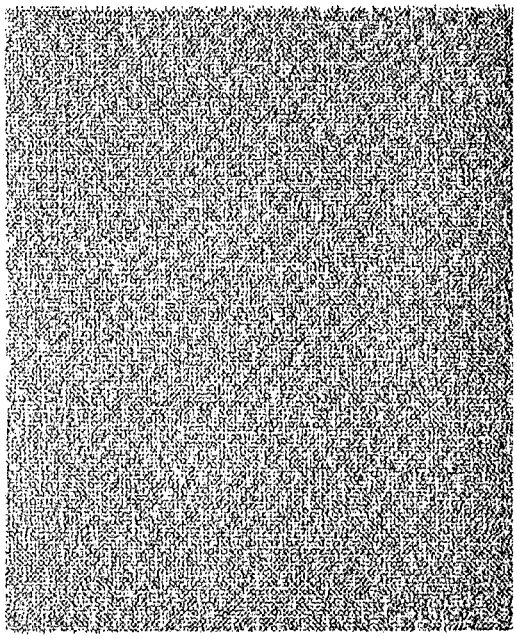
FIG. 6 is a photograph showing drawing patterns with respect to the industrial fabric according to the first embodiment of the present invention.
Figure 7:
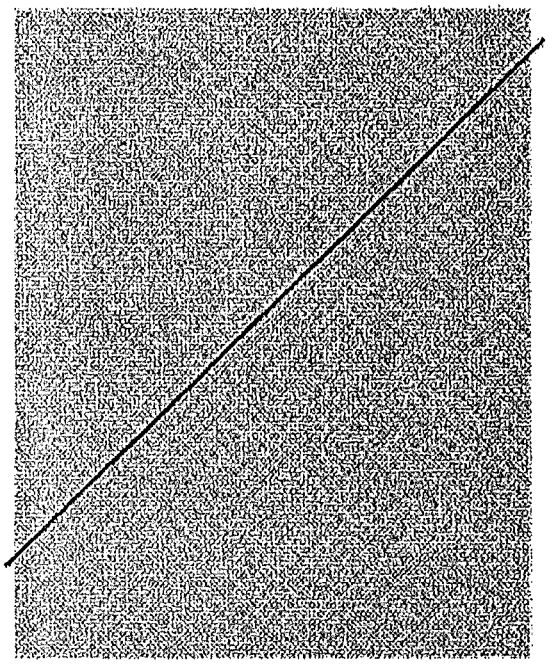
FIG. 7 is a photograph showing drawing patterns with respect to the conventional industrial fabric.

Drawing patterns are created by applying a thin paper on the upper surface of the fabric to trace them by means of a thick pencil, etc. so as to emerge on the thin paper. FIG. 6 is a photograph showing the drawing patterns of the industrial fabric according to the first embodiment.

As clearly shown in FIG. 6, it is found that white rhombus patterns separated from each other on the surface of the industrial fabric according to the first embodiment. It is also found that the consecutive diagonal drawing patterns which were generated on the surface of the conventional industrial fabric are not formed. As described above, such consecutive diagonal drawing patterns are the cause for the marking diagonally generated on the produced object.

In the industrial fabric according to the first embodiment, it was proved that an excellent technical effect that the marking can be prevented from consecutively diagonally generating on the surface of the produced object by controlling the formation of the concave portions can be caused.

1 concave binding yarn for pulling down
2 convex binding yarns for pushing up
3,4,5 upper surface side weft
N1 single knuckle
N2, N3 two or more single knuckles
3Lb, 4Lb (FIG. 2), 4Lb, 8Lb (FIG. 4) concave binding yarn for pulling down
4Lb, 8Lb (FIG. 2), 3Lb, 7Lb (FIG. 4) concave binding yarn for pushing up

What is claimed is:

1. An industrial fabric comprising:

an upper surface side fabric constituted by upper surface side warps and upper surface side wefts, wherein the upper surface side warps or the upper surface side wefts include a first upper surface side warp or weft, a second upper surface side warp or weft that is located adjacent to the first upper surface side warp or weft, and a third upper surface side warp or weft that is located adjacent to the second upper surface side warp or weft; and a lower surface side fabric constituted by lower surface side warps and lower surface side wefts;

said upper surface side fabric comprising:

a first binding yarn including a single knuckle in a repeating unit that is formed on an upper surface of the upper surface side fabric by passing over the second upper surface side warp or weft, passing under the first upper surface side warp or weft, and passing under the third upper surface side warp or weft, the first binding yarn passes under one of the lower surface side warps or the lower surface side warps or wefts;

a second binding yarn located adjacent to said first binding yarn, the second binding yarn passes under said second upper surface side warp or weft, passes over the first upper surface side warp or weft, passes over the third upper surface side warp or weft and passes under one of the lower surface side warps or wefts.

2. The industrial two-layer fabric according to claim 1, wherein said first binding yarn forms the knuckle by passing over the second upper surface side weft.

* * * * *